US009095750B2

(12) United States Patent
Schwenger

(10) Patent No.: US 9,095,750 B2
(45) Date of Patent: Aug. 4, 2015

(54) RACKET

(75) Inventor: Ralf Schwenger, Weiler im Allgäu (DE)

(73) Assignee: Head Technology GmbH, Kennelbach (AT)

( * ) Notice: Subject to any disclaimer, the term of this patent is extended or adjusted under 35 U.S.C. 154(b) by 1074 days.

(21) Appl. No.: 13/141,647

(22) PCT Filed: Dec. 21, 2009

(86) PCT No.: PCT/EP2009/067665

§ 371 (c)(1),
(2), (4) Date: Sep. 9, 2011

(87) PCT Pub. No.: WO2010/072726

PCT Pub. Date: Jul. 1, 2010

(65) Prior Publication Data

US 2011/0312451 A1 Dec. 22, 2011

(30) Foreign Application Priority Data

Dec. 22, 2008 (DE) ..... 10 2008 064 385

(51) Int. Cl.
*A63B 49/10* (2015.01)

(52) U.S. Cl.
CPC ..... *A63B 49/10* (2013.01); *A63B 2209/00* (2013.01)

(58) Field of Classification Search
CPC ..... A63B 49/00; A63B 49/02; A63B 49/027; A63B 49/10; A63B 2209/00
USPC ..... 473/524, 535, 536, 546, 547, 520, 521
See application file for complete search history.

(56) References Cited

U.S. PATENT DOCUMENTS

| | | | | |
|---|---|---|---|---|
| 4,440,392 | A * | 4/1984 | Popplewell | 473/535 |
| 4,725,059 | A * | 2/1988 | Du Gardin et al. | 473/536 |
| 4,828,259 | A * | 5/1989 | Davis | 473/522 |
| 5,133,552 | A * | 7/1992 | Feeney et al. | 473/537 |
| 5,178,386 | A * | 1/1993 | Tzeng | 473/521 |
| 5,310,516 | A | 5/1994 | Shen | |
| 5,527,038 | A | 6/1996 | Mabie | |
| 5,769,746 | A * | 6/1998 | Siegel | 473/524 |
| 6,319,159 | B1 * | 11/2001 | Yu | 473/535 |
| 6,638,187 | B1 | 10/2003 | Tsai | |

(Continued)

FOREIGN PATENT DOCUMENTS

| | | | |
|---|---|---|---|
| DE | 20 2006 012 256 | U1 | 1/2008 |
| EP | 0 574 626 | A1 | 12/1993 |

(Continued)

OTHER PUBLICATIONS

International Search Report for PCT/EP2009/067665, dated Apr. 4, 2010.

*Primary Examiner* — Raleigh W Chiu
(74) *Attorney, Agent, or Firm* — Bookoff McAndrews, PLLC

(57) ABSTRACT

The present invention relates to a racket for ball games having a frame comprising a head portion for receiving a stringing and a handle portion for gripping the racket, wherein the frame comprises at least one transparent or translucent portion formed from a transparent or translucent material, said transparent or translucent portion being integrally bonded to the remaining frame. Furthermore, a method for manufacturing such a racket is described.

19 Claims, 4 Drawing Sheets

(56) References Cited

U.S. PATENT DOCUMENTS

| | | | | |
|---|---|---|---|---|
| 7,503,860 | B2 * | 3/2009 | Gazzara et al. | 473/535 |
| 7,811,500 | B2 * | 10/2010 | Gazzara et al. | 264/314 |
| 7,867,428 | B2 * | 1/2011 | Filippini | 264/314 |
| 2006/0052187 | A1 * | 3/2006 | Pai | 473/546 |
| 2007/0123376 | A1 * | 5/2007 | Gazzara et al. | 473/524 |
| 2011/0105254 | A1 * | 5/2011 | Gazzara et al. | 473/524 |
| 2011/0312451 | A1 * | 12/2011 | Schwenger | 473/535 |

FOREIGN PATENT DOCUMENTS

| | | |
|---|---|---|
| FR | 2 592 804 | 7/1987 |
| GB | 2 436 296 A | 9/2007 |
| GB | 2 438 173 A | 11/2007 |

* cited by examiner

| stripe No. | material angle | stripe dimension (mm) wdth x length x number of stripes | layer x basis weight ($g/m^2$) |
|---|---|---|---|
| 1 | HC 15 | 50 x 400 | 2 x 100 |
| 2 | HG 15 | 50 x 120 * 2 | 2 x 130 |
| 3 | HC 25 | 50 x 520 * 2 | 2 x 125 |
| 4 | HC 0 | 55 x 400 | 1 x 100 |
| 5 | HG 25 | 55 x 120 * 2 | 2 x 100 |
| 6 | HC 0 | 55 x 520 * 2 | 2 x 100 |
| 7 | HC 25 | 55 x 320 | 2 x 100 |
| 8 | HG 25 | 55 x 220 * 2 | 2 x 100 |
| 9 | HC 25 | 55 x 460 * 2 | 2 x 100 |

RACKET

The present invention relates to racket for ball games, particularly a racket for tennis, badminton, racket ball or squash. The invention further relates to a method for manufacturing such a racket.

Such rackets for ball games typically comprise a frame forming a racket head or head portion and a handle section. Furthermore, such rackets may comprise a heart or heart portion or fork which is arranged between the head portion and the handle portion. The racket head thereby defines a stringing plane in which the stringing of the racket is arranged. For receiving the strings of the stringing through holes for holding the strings are provided at the frame in the stringing plane. These through holes may be U-shaped, as described in U.S. Pat. No. 6,638,187 B1, so that the strings are substantially turned around within the frame profile without penetrating the same.

Further, e.g. from U.S. Pat. No. 5,178,386, it is known to form the neck portion of such rackets from a transparent, rigid plastic such as nylon. The reasons therefore are exclusively esthetical. According to U.S. Pat. No. 5,178,386, the transparent neck portion should comprise a slot in which a printed card can be inserted. Thereby a decoration or labeling of the racket by directly printing thereon should be made superfluous.

In the meantime, rackets for ball games have a relatively complex design and comprise structures in their interior which usually remain hidden for the player. For example, the bearing of the bridge in the neck portion may require a complex inner structure of the frame structure. It would be quite advantageous to make these structures visible since the player could then, e.g., check these structures with regard to their functionality. Also in the case of the above mentioned U-shaped through holes for the strings it would be helpful when the strings would be visible in said through holes, since this might facilitate, e.g., threading or restringing.

Simultaneously, making the inner structure of a racket for ball games visible must not affect negatively the mechanical stability. As rackets are partially submitted to enormous forces and torques, there are high demands for rackets for ball games with regard to rigidity, stiffness against torsion and damping. Therefore, the frame of such a racket is usually formed by a frame profile which is often manufactured from a carbon-fiber reinforced plastics in a mold by blow molding. Incorporating transparent, rigid plastic elements as described in U.S. Pat. No. 5,178,386 may have a negative effect on the mechanical stability and/or break resistance.

It is an object of the present invention to provide a racket for ball games which allows, on the one hand, to make portions of the frame structure visible which are usually not visible, and on the other hand, to provide optimal mechanical properties. This object is achieved by the features of the independent claims. Preferred embodiments of the invention are described in the dependent claims.

The present invention is based on the idea to form transparent or translucent portions in a racket for ball games, said portions being integrally bonded to the remaining frame of the racket. Thereby, it has surprisingly torn out that the transparent or translucent portions have at least a neutral effect, in some cases even have an advantageous effect on the rigidity or torsion behavior and, thus, on the performance of the racket for ball games.

Accordingly, the present application provides a racket for ball games having a frame comprising a head portion for receiving the stringing and a handle portion for gripping the racket. Thereby, the frame comprises at least one transparent or translucent portion made from a transparent or translucent material, said portion being integrally bonded to the remaining frame.

Within the present invention, an integral bonding should be understood as a non-detachable (without destroying) connection which is substantially made of one piece. This means, the two portions should particularly not be screwed, riveted, snapped-in or otherwise detachably fixed together, rather they should be formed to a frame together in one common forming process. In said forming process the two portions are preferably formed and bonded in a single step. Preferably, apart from the transparency of the one portion, there is no difference recognizable between the various frame portions and in particular no fixing and/or transition portions. Particularly, no fixing layer, e.g. an adhesive layer or an adhesive tape, should be incorporated, which is formed, for example, by a subsequent bonding of the portions. The forming of the two portions in a common forming process has the advantage over, e.g., a subsequent boding that less process steps are necessary and an integral outer appearance is achieved.

"Transparent or translucent" should refer in this application to a material allowing a certain visibility through the material. Such a material can be, e.g., entirely transparent or translucent as it is known from glass or a comparably clear, translucent material. Equally, the material can be lightly turbid or milky, like milk glass or roughened acrylic glass. The transparent or translucent material, however, should allow the structures therein to be perceptible to a player, even though they might be blurred.

According to a particularly preferred embodiment of the racket for ball games according to the present invention, the translucent or transparent material comprises a transparent resin like, for example, Struktil R366T. It is further preferred that the transparent or translucent material comprises glass fibers. Here, E-glass, T-glass and S-glass as well as combinations thereof are particularly preferred.

According to a further aspect of the present invention a racket for ball games having a frame comprising a head portion for receiving the stringing and a handle portion for gripping the racket. Thereby, the frame comprises at least one transparent or translucent portion comprising a transparent resin and/or a glass fiber material. Using a glass fiber material allows thereby to fulfill the above mentioned high requirements with regard to the mechanical performance of the racket. According to the invention, by using glass fibers, particularly certain glass fiber types, it is achieved to provide a racket which is not inferior with regard to stability to the known rackets made from carbon fiber reinforced materials. Here, E-glass, T-glass and S-glass as well as combination thereof have proven to be particularly advantageous.

According to a particularly preferred embodiment of the above described racket for ball games, the transparent or translucent portion substantially exclusively consists of transparent resin or glass fiber material.

It is further preferred that the frame is formed by a frame profile and that the frame profile is made substantially entirely from the transparent or translucent material in the region of the transparent or translucent portion. In other words, the entire cross-section of the frame profile is preferably formed by the transparent or translucent material.

Preferably, the frame comprises at least two, for example, three, four, five or six transparent or translucent portions. According to a preferred embodiment, the racket for ball games further has a heart portion comprising a bridge and two arms, wherein the transparent or translucent portions each are provided at the transition between bridge and arms. Particularly the portion of the arm or the frame where the bridge is mounted, can be formed from the transparent or translucent material. Preferably, the bearing of the bridge or its bearing mechanism can be seen through the transparent or translucent portions.

According to a further preferred embodiment, the racket comprises a stringing formed by strings wherein at least one string, preferably two or three strings, run through the transparent or translucent portion. This embodiment is provided particularly in combination with the afore-mentioned U-shaped through holes for the strings. Such U-shaped through holes are described, for example, in U.S. Pat. No. 6,638,187 B1. A transparent or translucent design of the material surrounding said through holes allows a player to check the quality of the through holes, and facilitates the threading of the strings during stringing.

According to a further aspect of the present invention, a method for manufacturing a racket, particularly a racket as described above, is provided. Accordingly, a first windable or coilable laminate material and a second windable or coilable laminate material are provided. The first windable laminate material comprises carbon fibers and the second windable laminate material comprises glass fibers. Subsequently, the first and second laminate materials are wounded or coiled into a tube. Finally, the tube is formed into a racked frame having a frame profile in a mold. This is performed at a pressure and a temperature each being above the standard conditions. In the completed frame profile, the second laminate material defines at least one transparent or translucent portion.

Preferably, the first and second laminate materials for forming the tube are arranged partially overlapping each other. Thereby, preferably at least two, preferably three, layers of the first and/or second laminate material are arranged over one another. In case, for example, three layers of each the first and second laminate material are arranged over one another, the layer system will comprise six layers in the transition or overlapping regions where the layers of the first and second laminate material overlap each other. However, when all transition regions lie over one another weaknesses in the racket frame may occur. Thus it is preferred, that the transition or overlapping regions between the first and second laminate materials have an off-set to each other.

It is further preferred that the second laminate material comprises a transparent resin.

In the following rackets according to the present invention are described in more detail by means of various preferred embodiments.

Figures 4A, 4B:
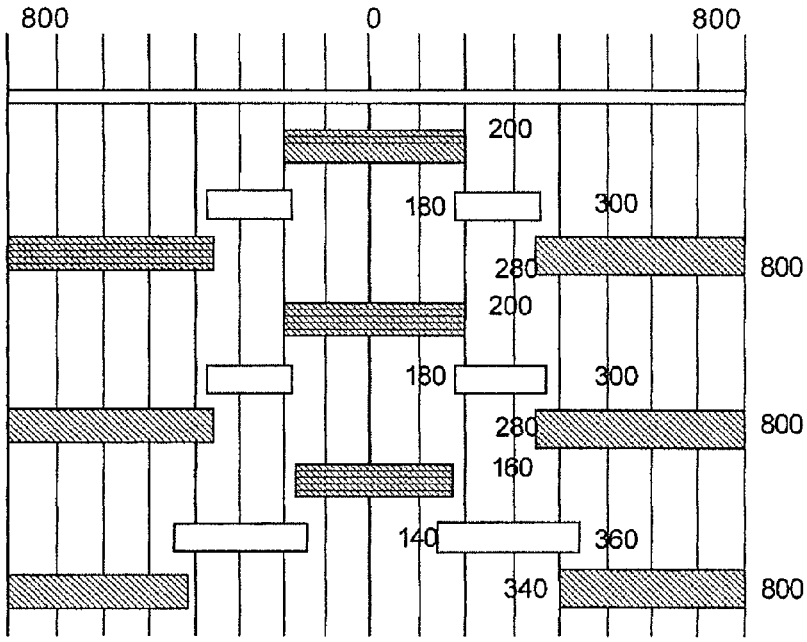

FIG. 4*a* is a diagrammatic illustration of material layers in a racket according to the present disclosure.

FIG. 4*b* is a table detailing properties of material layers according to the present disclosure.

Figure 1:
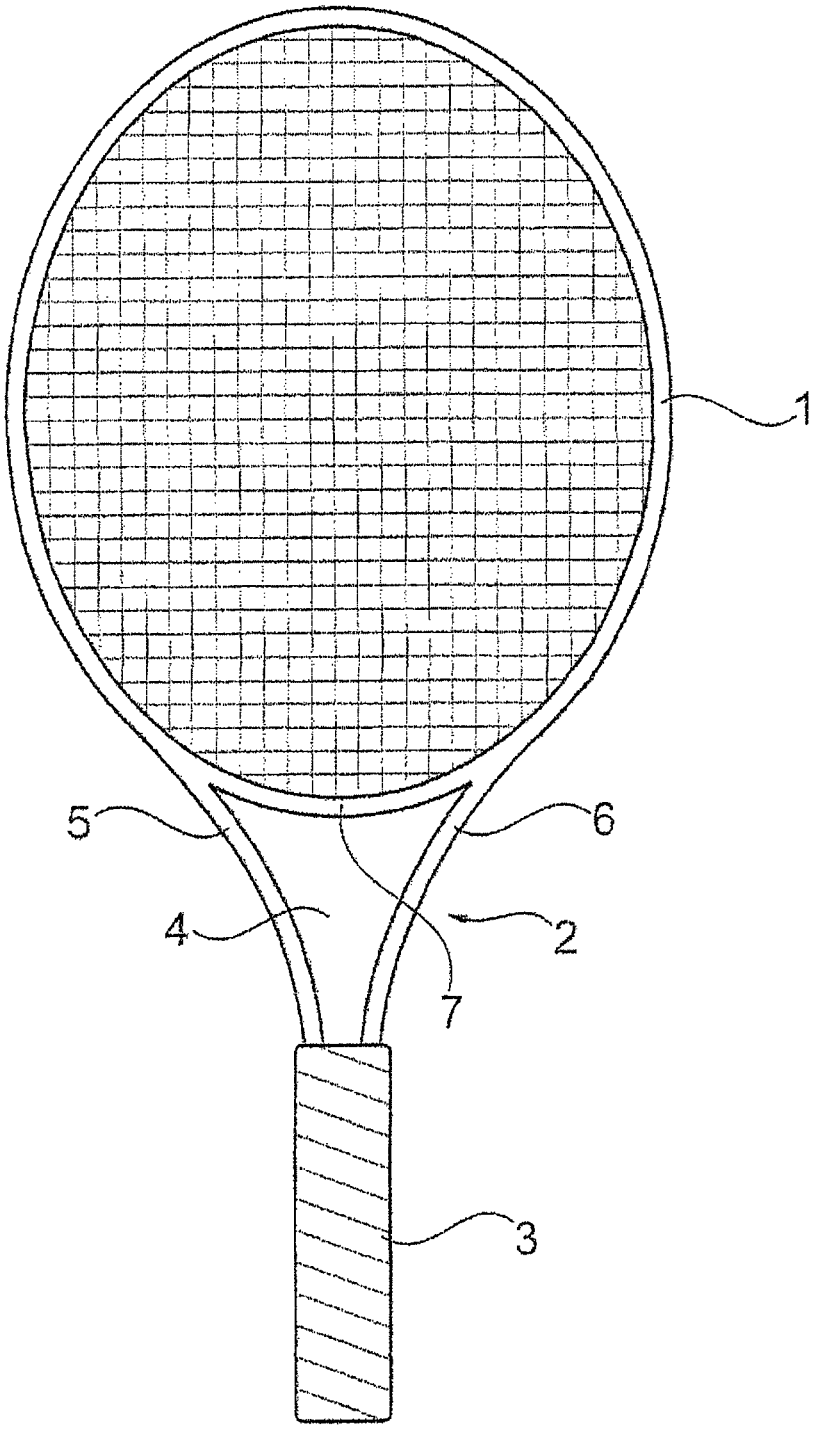
FIG. 1 shows a schematic top view of a conventional racket.

FIG. 1 shows a conventional racket for ball games, particularly a tennis racket, in top view. The racket for ball games comprises a frame forming an essentially oval racket head or head portion 1, a neck portion 2 and a handle portion 3. The frame is preferably made of a frame profile or hollow profile. The racket head 1 defines a stringing plane of the racket. For receiving the strings, the frame comprises a plurality of through holes (not shown) being essentially arranged in the stringing plane, for holding the strings. The heart portion 2 of the racket is substantially arranged between the head portion 1 and the handle portion 3 and presents a connecting portion therebetween. The heart portion 2, as shown in FIG. 1, comprises an opening 4. This is generally formed by two side portions or arms 5 and 6 as well as an connecting portion or bridge 7 which is arranged in the head portion of the racket.

Figure 2:
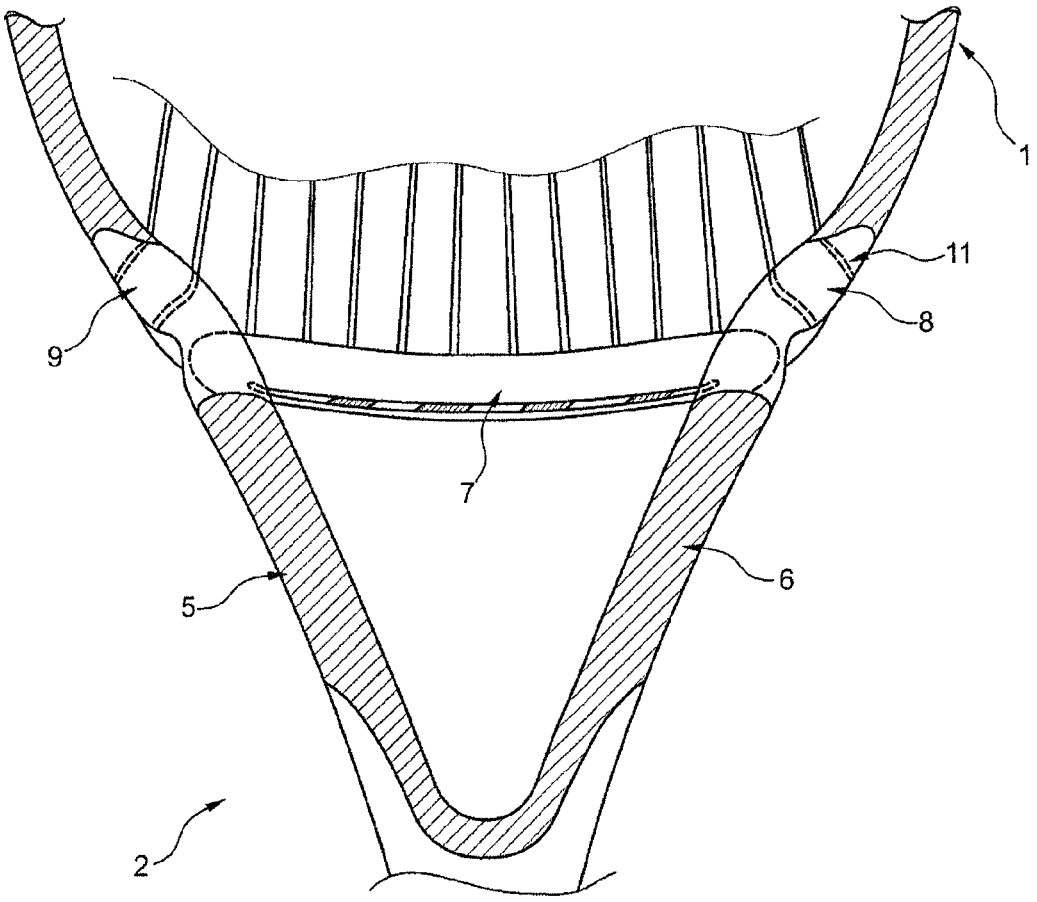
FIG. 2 shows a top view of a detail of a racket for ball games according to the present invention according to a preferred embodiment.

FIG. 2 shows a detail of a racket for ball games according to a preferred embodiment of the present invention. Substantially, the lower portion of the head portion 1 and the heart portion 2 can be seen. At the bottom end, the transition into the handle portion 3 is indicated. In this embodiment, the bridge 7 is supported at the arms 5 and 6. As can be clearly seen in FIG. 2, the racket for ball games according to this preferred embodiment of the present invention comprises two transparent or translucent portions 8 and 9 being arranged in the transition area of the bridge 7 into the arms 5 and 6. Particularly, according to this embodiment the bridge 7 is supported at or in the transparent portions 8 and 9. Thus, the bearing of the bridge 7 or its bearing mechanism can be seen through the transparent or translucent portions.

This provides multiple advantages. On the one hand, the player gets to know constructive details which otherwise remain hidden to him. On the other hand, the transparent or translucent portions 8 and 9 allow the checking or inspection of the bearing of the bridge 7. If, for example, the bridge has been released from the bearing or the bridge 7 has been displaced out of a symmetric bearing position, this can be seen through the transparent or translucent portions 8 and 9. The player can then react to this situation and may correct the position of the bridge prior to causing, e.g., a damage to the bearing. This can particularly be important for the stringing of the racket since the performance of the racket may be negatively affected when the bridge 7 is not in the correct position or even a damage to the racket may occur. In a similar manner the player can check the bearing mechanism for potential defects.

Further, in the embodiment according to FIG. 2 a string 11 is run through each of the transparent or translucent portions 8 and 9. This can also be advantageous, for example, for checking the position of the string. Particularly the transparency of the portions 8 and 9 facilitates the threading of the string during restringing.

Figure 3:
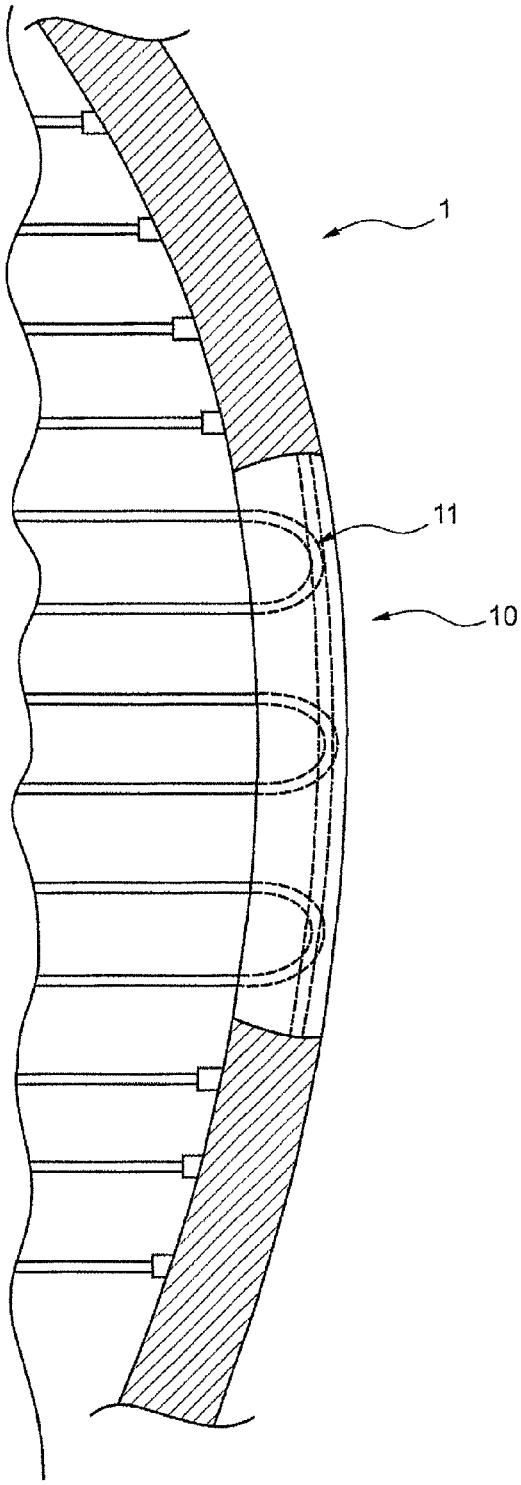
FIG. 3 shows a top view of a detail of the head portion of a racket for ball games according to a preferred embodiment of the present invention.

In FIG. 3, a detail of a racket for ball games according to a further preferred embodiment of the present invention can be seen. Substantially, the upper end portion, i.e., approximately the 12 o'clock-position, is shown. Equally, the shown section can be positioned at the side of the head portion 1, e.g., in the area between the 2 o'clock- and 4 o'clock position or between the 8 o'clock- and 10 o'clock position or at any other circumferential position of the head portion 1. The section of the racket head 1 comprises a transparent or translucent portion 10. This is preferably integrally bonded to the remaining frame profile of the racket head 1. In the preferred embodiment shown, three strings 11 are running through the transparent portion 10. The guiding of the strings 11 are performed by means of the U-shaped string guides or openings as described, e.g., in U.S. Pat. No. 6,638,178 B1. Particularly with the U-shaped string guides the transparency of portion 10 can considerably facilitate threading or guiding of a string through the U-shaped holes. Further, the transparency of the portions 10 allows an easy quality check of the U-shapes holes and/or the string.

It should be clear to the person skilled in the art, that according to the present invention one or two strings instead of three strings 11 as shown in FIG. 3 may run through the transparent portion 10. Equally, the transparent or translucent portion 10 can be formed in a greater extent so that even more strings, e.g. four, five or six strings, can run through the transparent portion 10. Further, the transparent or translucent portion 10 can be provided at any position at the racket frame. Equally, multiple transparent portions 10 can be distributed around the circumference of the racket head. Thereby, a symmetric positioning of the portions 10 is particularly advantageous.

According to the embodiments of FIGS. 2 and 3, the transparent or translucent portions 8, 9 and 10 are formed such that the entire frame profile is substantially entirely, i.e., the entire cross-section thereof, formed from the transparent or translucent material. Alternatively, it is also possible to form only a part of the profile of the cross-section from the transparent or translucent material. This may be advantageous with regard to the mechanical stability of the racket.

The racket according to the present invention can, as already mentioned, be manufactured by stretch blow molding. Accordingly, first a first windable laminated material of a conventional carbon fiber and a second windable laminated material of glass fiber prepreg being impregnated with a transparent resin are provided. The carbon fiber layers and the glass fiber layers are wound into a tube whereby the carbon fiber layers and the glass fiber layer partially overlap.

In FIG. 4, an exemplary laminating scheme is shown which indicates the arrangement of the carbon fiber layers (HC) and the glass fiber layers (HG). In FIG. 4*a*, the positioning of the layers along the tube forming the racket is shown. Here, "0" (i.e. 0 mm) indicates the head side of the racket and "800" (i.e. 800 mm) indicates the respective tube ends at the racket handle. In the example of FIG. 4*a*, three layers HC and three layers HG are provided respectively. At the 3 o'clock position or the 9 o'clock position of the racket head (i.e. between 200 mm and 280 mm, respectively) transparent portions are provided which are formed by three layers HG.

It is preferred that the overlapping regions have a slight off-set to each other. Accordingly, FIG. 4*a* shows, that the upper overlapping regions (between 180 mm and 200 mm and between 280 mm and 300 mm, respectively) are exactly positioned over one another, while the lower overlapping regions (between 140 mm and 160 mm and 340 mm and 360 mm, respectively) are arranged with an off-set thereto. Alternatively, it is also possible that all three overlapping regions lying over one another have an off-set to each other.

From FIG. 4*b*, the properties of the various layers can be taken. Here, the material, the angle of the fiber orientation with regard to the longitudinal axis of the tube in degrees, the dimension of the layer, the number of the required stripes, the number of the layers as well as the basis weight or grammage in $g/m^2$ are indicated. For example, the first layer is formed from HC wherein the angle of the fiber orientation with regard to the longitudinal axis of the tube is 15°. The layer has a dimension of 50 mm×400 mm and has two layers with a basis weight of 100 $g/m^2$.

It should be clear, that this arrangement of the layers is to be taken as an example only and another arrangement, orientation and dimensioning of the layers is also possible.

Finally, the tube is formed into a frame having a frame profile. This is achieved at a pressure and a temperature each exceeding the standard conditions.

The invention claimed is:

1. A racket for ball games having a frame comprising a head portion for receiving a stringing and a handle portion for gripping the racket, wherein the frame comprises at least one transparent or translucent portion, wherein the entire cross-section of the frame at the at least one transparent or translucent portion is formed from a transparent or translucent material, said transparent or translucent portion being integral to a remaining portion of the frame.

2. The racket according to claim 1, wherein the transparent or translucent portion is commonly formed with the remaining portion of the frame.

3. The racket according to claim 1, wherein the transparent or translucent material comprises a transparent resin.

4. The racket according to claim 1 wherein the transparent or translucent material comprises glass fibers.

5. The racket according to claim 4, wherein the glass fiber material comprises one or a combination of the following glass fiber types: E-glass, T-glass and S-glass.

6. The racket according to claim 1, wherein the transparent or translucent portion substantially exclusively consists of transparent resin and glass fiber material.

7. The racket according to claim 1, wherein at least two transparent or translucent portions are provided.

8. The racket according to claim 1 further having a heart portion comprising a bridge and two arms, wherein the transparent or translucent portions are provided at the transition and/or the in the bearing portion between bridge and arms, respectively.

9. The racket according to claim 8, wherein the bearing of the bridge at the arms is visible through the transparent or translucent portion.

10. The racket according to claim 1 further having strings forming a stringing, wherein at least one string runs through the transparent or translucent portion.

11. The racket according to claim 10, wherein the at least one string is visible through the transparent or translucent portion.

12. A method for manufacturing a racket, particularly a racket according to claim 1 comprising the following steps:

a) providing a windable first laminate material and a windable second laminate material;

b) winding the first and second laminate materials into a tube; and c) forming the tube into a frame having a frame profile in a mold under the influence of pressure and temperature; wherein the first laminate material comprises carbon fibers and the second laminate material comprises glass fibers and the second laminate material defines at least one transparent or translucent portion.

13. The method according to claim 12, wherein the second windable laminate material further comprises a transparent resin.

14. The racket according to claim 1, wherein the cross-section of the frame extends in a direction that is substantially perpendicular to a longitudinal axis of the frame.

15. A method of manufacturing a racket, the racket having a frame comprising a head portion for receiving a stringing and a handle portion for gripping the racket, wherein the frame comprises at least one transparent or translucent portion formed from a transparent or translucent material, said transparent or translucent portion being integral to a remaining portion of the frame, the method including:

providing a windable first laminate material and a windable second laminate material;

winding the first and second laminate materials into a tube; and forming the tube into the frame having a frame profile in a mold under the influence of pressure and temperature; wherein the first laminate material comprises carbon fibers and the second laminate material comprises glass fibers and the second laminate material defines at least one transparent or translucent portion, wherein the first and second laminate materials are arranged partially overlapping.

16. The method according to claim 15, wherein at least two layers of the first and/or second laminate materials are arranged over one another.

17. The method according to claim 15, wherein the overlapping regions between the first and second laminate material have an off-set to each other.

18. A racket having a frame comprising a head portion extending along a longitudinal axis from a handle portion, the head portion having a cross-section that extends substantially perpendicular to the longitudinal axis, wherein the frame comprises at least one transparent or translucent portion, wherein the entire cross-section of the frame at the at least one transparent or translucent portion is formed from a transparent or translucent material, said transparent or translucent portion being integral to a remaining portion of the frame.

19. The racket according to claim 18 further having strings forming a stringing, wherein at least one string is disposed through the transparent or translucent portion.

* * * * *